United States Patent [19]

in't Hout et al.

[11] 4,456,119

[45] Jun. 26, 1984

[54] DEVICE FOR ELEVATING A LIQUID

[75] Inventors: Henk H. in't Hout, Hank; Rudolf H. Loevendie, Alblasserdam, both of Netherlands

[73] Assignee: IHC Holland N. V., Papendrecht, Netherlands

[21] Appl. No.: 291,058

[22] Filed: Aug. 7, 1981

[30] Foreign Application Priority Data

Aug. 8, 1980 [NL] Netherlands ..... 8004528

[51] Int. Cl.[3] ..... B65G 47/20

[52] U.S. Cl. ..... 198/535; 198/702; 198/703

[58] Field of Search ..... 198/702, 703, 706, 712, 198/528, 534, 535, 643, 509; 222/369, 371

[56] References Cited

U.S. PATENT DOCUMENTS

| | | | |
|---|---|---|---|
| 269,295 | 12/1882 | Kirby | 198/702 |
| 277,212 | 5/1883 | Brimer | 198/702 |
| 1,481,735 | 1/1924 | Peck . | |
| 1,685,907 | 10/1928 | Cirou . | |
| 2,013,215 | 9/1935 | Langenberg | 198/702 |
| 2,494,165 | 1/1950 | Diebold | 198/535 |
| 2,694,366 | 11/1954 | Miller . | |
| 3,874,101 | 4/1975 | Cummins | 198/509 |
| 4,184,584 | 1/1980 | Dehlen | 198/706 |

FOREIGN PATENT DOCUMENTS

| | | | |
|---|---|---|---|
| 556 | 9/1877 | Fed. Rep. of Germany . | |
| 715179 | 12/1941 | Fed. Rep. of Germany | 198/703 |
| 2510499 | 9/1976 | Fed. Rep. of Germany . | |
| 389580 | 9/1908 | France . | |
| 391038 | 10/1908 | France . | |
| 609378 | 8/1926 | France . | |

*Primary Examiner*—Joseph E. Valenza
*Assistant Examiner*—Daniel Alexander
*Attorney, Agent, or Firm*—Young & Thompson

[57] ABSTRACT

A device for elevating water by means of a vertical chain (5,21) of buckets (10,20) supported and driven by an upper reversing wheel (7,25), the lower part of the bucket chain (5,21) running through a filling tank (1,15) having a height adjustable overflow edge (4,18) over which water from the lower level (2,19) may flow into the passing buckets (10,20). Structure (11,25') is provided for discharging the buckets (10,20) at the higher level (13,39). The bucket chain (21) in its entirety preferably is adjustable in the vertical direction.

8 Claims, 5 Drawing Figures

DEVICE FOR ELEVATING A LIQUID

The invention relates to a device for elevating a fluid, such as water, from a low level to a higher level, comprising an endless conveyor with containers such as buckets, positioned at a mutual distance of each other and functioning for receiving the fluid at said low level and discharging the fluid at said higher level. Such devices are commonly known especially in the form of a water wheel, that means a driven wheel scooping water from the low level, which water at the higher level flows by itself out of the containers into which the water was scooped at said low level.

The power necessary for driving such a device is determined by the number of revolutions and by the filling degree of said containers. The height over which the fluid can be elevated depends on the diameter of said water wheel, however, taking into account the overflow losses, the effective elevating height can be only a small part of the diameter of said water wheel. For driving such a device usually driving systems are available of which the available output power is variable. A known example of such a driving system is a wind mill.

An object of the invention is now to provide a device which does not need much space, has an increased elevating height and is suited to be adapted to the available driving force and to the number of revolutions of the output shaft of the driving system.

Said object according to the invention is reached in that the conveyor consists of a bucket chain of which the chain adjacent to the high level runs over a reversing wheel, whereas the lowest part of said bucket chain is positioned in a falling tank having low level fluid supply means controlable as to the fluid flow rate, whereby fluid is supplied to buckets in the rising section of the bucket chain.

The bucket chain which in itself is known for dredging operations and for transport of bulk materials, occupies in the horizontal direction a relatively small area and can extend in the vertical direction over a much greater effective height than is possible with a water wheel. By positioning the lowest part of said bucket chain in a filling tank and by using low level fluid supply means which are controlable as to the fluid flow rate, it is possible to adapt the filling degree of said buckets to the available driving force.

Preferably the controlable supply means comprises a vertically adjustable slider positioned between the low fluid level and the filling tank, which slider has an overflow edge across which the fluid can flow into said buckets. In the lowered position of said slider an increased amount of fluid will flow from said low level in the direction of said filling tank and will be received in said buckets after passing the overflow edge. If said slider is raised to a higher level, then the amount of fluid flowing over the edge will be decreased so that the buckets, moving with the same speed, will be filled to a minor degree.

To prevent the buckets from being pushed aside, by the fluid jet stream during charging of said buckets, the chain can be guided by guide rollers, positioned at the side of the chain opposite the fluid supply side in the proximity of said fluid supply. Preferably said guide rollers are mounted on said vertically adjustable slider, so that they are always approximately opposite the fluid stream. It is also possible to install a second chain reversing wheel in said filling tank.

Overflow losses, received by said filling tank, will be scooped up by the lowest buckets when a certain level is exceeded. Usually the fluid flowing over said overflow edge will have a sufficient speed to cross the gap between said edge and the adjacent bucket rim. It is however conceivable that the overflow edge is embodied elastically and is positioned in the path of the outer rim of said buckets. The buckets, tightly connected to the links of the bucket chain, will then be able to press such an elastic edge aside very easily.

For discharging said buckets the bucket chain can be guided by an auxiliary wheel in the proximity of the higher level reversing wheel such that the chain with the thereto connected buckets is brought into a position in which said buckets are discharged. This auxiliary wheel, which is for instance positioned underneath the reversing wheel, is such that the chain runs along a slanted path whereby the buckets automatically are brought into a position in which the fluid, contained in said buckets, will be discharged into a gutter and will flow therethrough to the higher level.

It is also possible to design the device such that the buckets are pivotably connected to said chain at a point above their center of gravity and the device comprises means in the proximity of the higher level reversing wheel for cantilevering said buckets around a horizontal pivot shaft. In the rising section of the bucket chain said buckets can be filled to the desired degree near said overflow edge and in the upper section of the device said buckets encounter a control element causing cantilevering of said buckets over a sufficient angle to become discharged. Said buckets will in general not pass through the charging tank with a scooping motion, but when the fluid level in said tank becomes too high said buckets, then floating on the fluid in said charging tank, will be brought into a position in which they will receive fluid.

The higher level is not necessarily invariable. To avoid potential energy loss it is according to the invention desirable that the bucket chain as a whole is height adjustable. In that case, the height at which the fluid is discharged from the buckets can be advantageously adapted to the existing higher fluid level.

The invention will now be explained in more detail with reference to the attached drawings.

Figure 1:
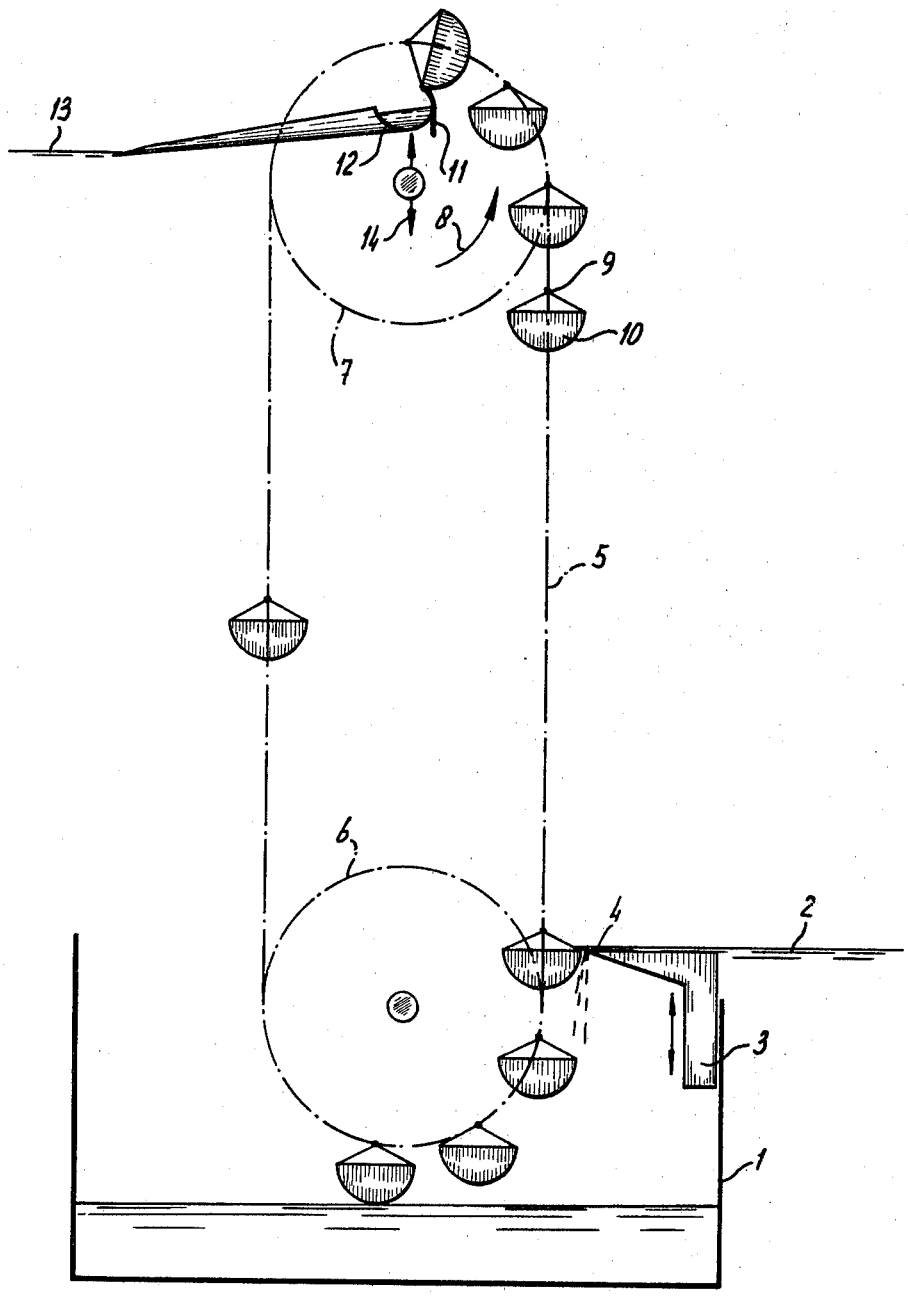
FIG. 1 shows schematically an embodiment of the device according to the invention.

FIG. 1 illustrates a filling tank 1, which is in a fixed or floating way installed at the lower level, which level is indicated by the line 2. Said tank has a slider 3 with overflow edge 4, adjustable in a vertical direction. The height adjustment of said slider 3 determines how much water per unit of time will flow over said overflow edge into said filling tank.

In and above said filling tank a bucket chain 5 is installed comprising two endless chains, positioned at a mutual distance, the links of which are guided over a lower chain wheel 6 and an upper chain wheel 7. The upper chain wheel 7 is driven by not illustrated driving means in the direction of the arrow 8. The lower chain wheel 6 can be omitted, in which case the lower part of said bucket chain hangs free in the tank 1.

Rods 9, from which the buckets 10 are pivotally suspended, are positioned transversely between said two chains 5. Said pivot shaft 9 is positioned above the center of gravity of the corresponding bucket 10 when said bucket is empty as well as when said bucket is filled. Because the buckets 10 pass with their outwards directed rim close to the overflow edge 4 the water flowing over said overflow edge will be received into each of the rising buckets.

Near the upper reversing wheel 7 a fixed control element 11 reaches into the path of the buckets 10 and is embodied such that the buckets, running into said element, are tilted to the position illustrated in the upper section in FIG. 1, so that the contents flow out of the buckets into a gutter 12, draining said water sidewards to the higher level 13. Upon further movement the empty bucket will tilt back to the original position and will move downwards with the lowering chain section into the filling tank and thence to the rising chain section. The whole bucket chain including the gutter 12 can be adjusted in height, as is indicated by the arrow 14, so that an optimal adaptation in relation to the higher fluid level 13 is possible. Said height adjustment has no significant influence on the filling degree of the buckets.

Figure 2:
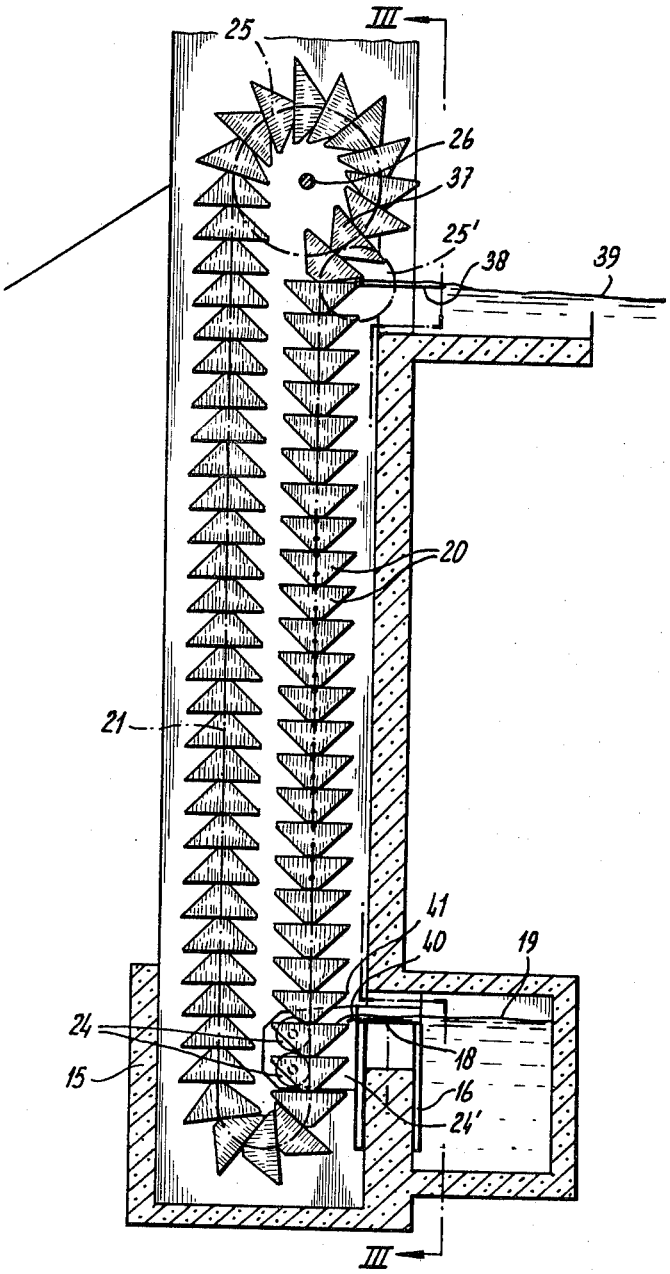
FIG. 2 shows a side view of a more detailed embodiment of the device according to the invention, differing from the embodiment in FIG. 1.
Figure 3:
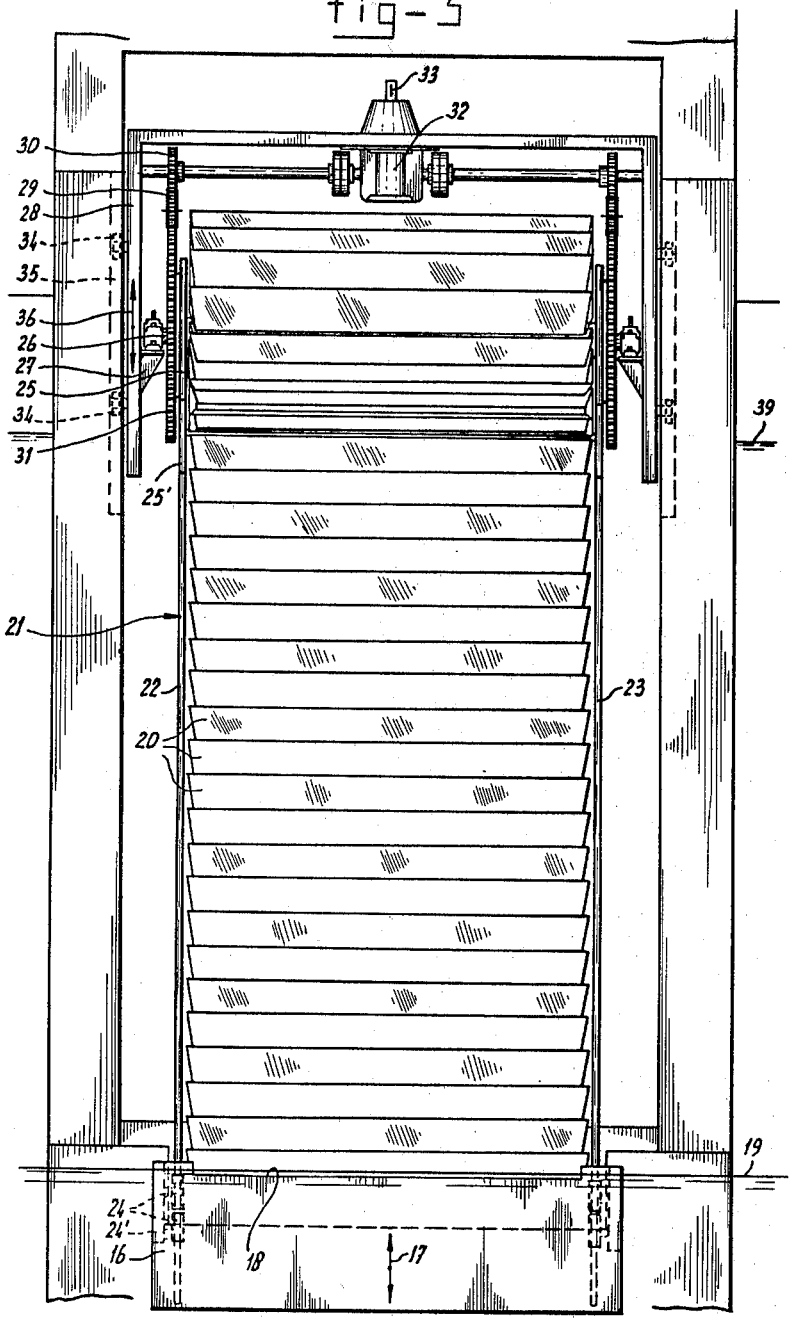
FIG. 3 shows a sectional view on the line III—III in FIG. 2.

In the embodiment of the FIGS. 2 and 3 the filling tank is indicated at 15 and comprises a height adjustable slider 16, movable in the direction of the arrow 17 and having an overflow edge 18 such that water from the lower level 19 can flow over said overflow edge 18 into the filling tank 15. The height of the edge 18 determines the amount of water flowing into said filling tank.

A double bucket chain consisting of an uninterrupted series of buckets 20, connected to the links of the chain 21, runs through the filling tank.

Said bucket chain which comprises two endless chains at a mutual distance from each other, with buckets 20 between the chains 22 and 23 runs over the reversing wheel 25, whereas the lower part thereof hangs free in the filling tank 15. Near said lower section the chain guiding rollers 24 are installed to prevent, especially with a high charging speed, the buckets 20 from being pressed aside by the fluid stream flowing over said overflow edge. The rollers 24 are by means of the plates 24' mounted on the slider 16, so that they are always approximately opposite the fluid stream.

It is however also possible in this embodiment to use a lower reversing wheel as is illustrated in FIG. 1.

Figure 4:
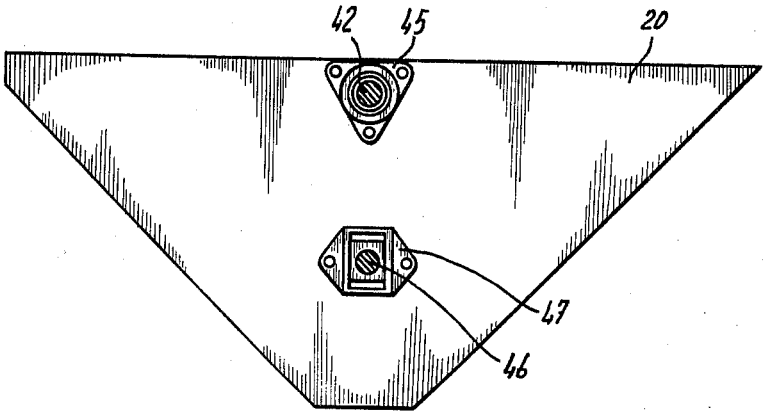
FIGS. 4 and 5 show on larger scale the connection of the buckets to the chain in the embodiment shown in FIGS. 2 and 3.
Figure 5:
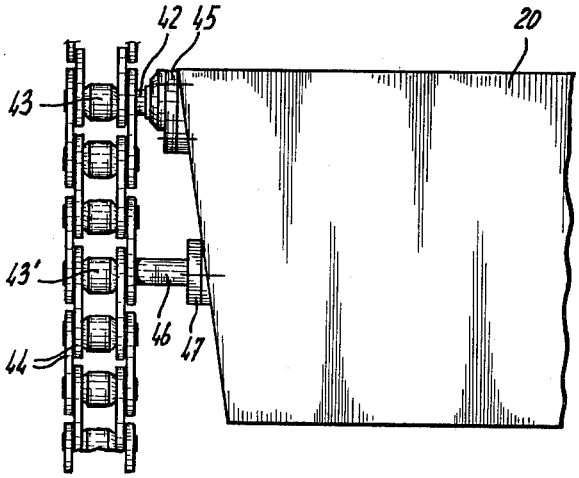

As is illustrated in FIGS. 4 and 5 the buckets are connected by means of an elongated part 42 of a pin 43 between the links 44 of the chain, which part is at 45 tightly connected to the bucket 20, whereas a further elongated part 46 of a pin 43' at a distance from the pin 43 is received in a sliding shoe 47 connected to said bucket 20.

The shaft 26 of the reversing wheels 25 is supported in bearings, connected to the brackets clamps 27 of a frame 28 which is adjustable in a vertical direction, in which frame the toothed wheels 29 and 30 are borne, of which the toothed wheel 29 cooperates with a bigger toothed wheel 31, positioned on the same shaft as the reversing wheels 25.

The toothed wheels 30 are driven from a gear box 32, of which the input shaft 33 through a height adjustment permitting key way is connected to the output shaft of for instance a wind mill.

The frame 28 is guided by means of guiding wheels 34 in a guide way 35 which is indicated by broken lines. The adjustment of the frame 28 in a vertical direction corresponding to the arrows 36 may be carried out by a suitable mechanism, such as a screw jack, a screw spindle or a similar device.

Underneath the reversing wheel 25 an auxiliary wheel 25' is installed. This auxiliary wheel guides the chain links from their vertical path around the circumference of the wheel 25, so that the buckets will come into the position indicated by 37 in which said buckets discharge into a gutter 38 draining the fluid to the higher level 39.

The slider 16 can have a elastic strip 40 attached to the overflow edge extending over a small distance into the path of the rims 41 of the buckets 20. The losses of the fluid flowing over the edge 18 and over said strip 40 into the buckets 20 are therefore kept to a minimum. Each bucket will press said strip upwards so that said bucket is able to pass.

We claim:

1. Device for elevating a liquid from a low level to a higher level, comprising an endless bucket conveyor, a reversing wheel adjacent said higher level over which the bucket conveyor runs, a filling tank into which the lower end of the bucket conveyor dips, means to circulate the bucket conveyor so that one run thereof ascends while another run thereof descends, and means to supply liquid to the ascending run of the bucket conveyor at a point above the liquid level in the filling tank, said supply means comprising a vertically adjustable slider over which liquid flows into the buckets.

2. Device according to claim 1, and guide rollers engaging and guiding the bucket conveyor adjacent said liquid supply means and on the opposite side of said bucket conveyor from said liquid supply means.

3. Device according to claim 2, said rollers being mounted on said vertically adjustable slider for vertical movement therewith.

4. Device according to claim 1, and a second chain reversing wheel disposed in said filling tank and about which the lower end of the bucket conveyor runs.

5. Device as claimed in claim 1, said slider having an elastically deformable lip in the path of the outer portions of said buckets, whereby said buckets deflect said lip when rising past said slider.

6. Device as claimed in claim 1, and a bucket discharge wheel disposed on the outer side of said bucket conveyor below said reversing wheel to tip said buckets to discharge liquid from said buckets.

7. Device as claimed in claim 1, the buckets being pivotally connected to the conveyor at a point above their center of gravity, and means to swing the buckets about their point of pivotal connection adjacent said reversing wheel to tip the buckets to discharge liquid from the buckets.

8. Device as claimed in claim 1, and means to adjust the height of the bucket conveyor.

* * * * *